US010427269B2

(12) United States Patent
Kashiwagi et al.

(10) Patent No.: US 10,427,269 B2
(45) Date of Patent: Oct. 1, 2019

(54) POLISHING APPARATUS AND POLISHING METHOD

(71) Applicant: EBARA CORPORATION, Tokyo (JP)

(72) Inventors: Makoto Kashiwagi, Tokyo (JP); Michiyoshi Yamashita, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 281 days.

(21) Appl. No.: 15/478,459

(22) Filed: Apr. 4, 2017

(65) Prior Publication Data

US 2017/0291273 A1 Oct. 12, 2017

(30) Foreign Application Priority Data

Apr. 8, 2016 (JP) ..... 2016-078491

(51) Int. Cl.

| | |
|---|---|
| ***B24B 9/06*** | (2006.01) |
| ***B24B 21/00*** | (2006.01) |
| ***B24B 49/16*** | (2006.01) |
| ***B24B 51/00*** | (2006.01) |

(52) U.S. Cl.

CPC ..... *B24B 9/065* (2013.01); *B24B 21/002* (2013.01); *B24B 49/16* (2013.01); *B24B 51/00* (2013.01)

(58) Field of Classification Search

CPC ..... B24B 9/065; B24B 21/002; B24B 37/005; B24B 37/013; B24B 47/22; B24B 49/16; B24B 49/006; B24B 51/00; H01L 21/304

See application file for complete search history.

(56) References Cited

U.S. PATENT DOCUMENTS

2004/0072499 A1* 4/2004 Wakabayashi ..... B08B 1/04 451/5
2007/0270081 A1 11/2007 Crocco et al.
2010/0311309 A1* 12/2010 Shinozaki ..... B24B 49/08 451/5
2014/0213154 A1* 7/2014 Seki ..... B24B 21/004 451/44
2014/0329446 A1* 11/2014 Nabeya ..... B24B 37/30 451/282

FOREIGN PATENT DOCUMENTS

JP 2014-150131 A 8/2014

OTHER PUBLICATIONS

European Patent Application No. 17164741.5; Extended Search Report; dated May 29, 2017; 10 pages.

* cited by examiner

*Primary Examiner* — Joseph J Hail
*Assistant Examiner* — J Stephen Taylor
(74) *Attorney, Agent, or Firm* — Baker & Hostetler LLP

(57) ABSTRACT

A polishing apparatus which can maintain a polishing load within an appropriate range is disclosed. The polishing apparatus includes: a pressing member for pressing a polishing tool against the substrate; an actuator configured to control a pressing force of the pressing member; a positioning member which is movable together with the pressing member; a stopper arranged to restrict movement of the pressing member and the positioning member; a stopper moving mechanism configured to move the stopper in a predetermined direction; a polishing-load detector configured to obtain a load feedback value which varies according to a polishing load applied to the pressing member; and a stopper-speed determining device configured to determine a movement speed of the stopper which can allow the load feedback value to fall within a set range.

8 Claims, 15 Drawing Sheets

PRIOR ART

PRIOR ART

POLISHING APPARATUS AND POLISHING METHOD

CROSS REFERENCE TO RELATED APPLICATION

This document claims priority to Japanese Patent Application No. 2016-078491 filed Apr. 8, 2016, the entire contents of which are hereby incorporated by reference.

BACKGROUND

Control of a surface condition of a wafer has recently attracted attention from the viewpoint of increasing a yield in manufacturing of a semiconductor device. In a semiconductor device manufacturing process, films of various materials are formed on a silicon wafer. Therefore, an unnecessary film(s) and surface roughness are formed in a peripheral portion of the wafer. These days it is common practice to transfer a wafer while holding only a peripheral portion of the wafer with an arm. With such a background, an unnecessary film, remaining on a peripheral portion of a wafer, may peel off during various processes and may adhere to a device formed on the wafer, resulting in reduced yield. In order to remove an unnecessary film from the peripheral portion of the wafer, a polishing apparatus is used to polish the peripheral portion of the wafer.

FIG. 15 is a schematic view of a conventional polishing apparatus. A wafer W to be polished includes a first silicon layer 201 having an exposed surface, a patterned layer 202 underlying the first silicon layer 201, and a second silicon layer 203 underlying the patterned layer 202. A polishing tape 205 for polishing the wafer W is pressed by a pressing member 208 against an edge portion of the wafer W. The pressing member 208 is coupled to an air cylinder 209, and a force that presses the polishing tape 205 against the wafer W is applied from the air cylinder 209 to the pressing member 208. A positioning member 211 is secured to a rod of the air cylinder 209, and the positioning member 211 and the pressing member 208 are moved together by the air cylinder 209. A stopper 212 is in contact with a lower surface of the positioning member 211. Thus, the movement of the pressing member 208 and the polishing tape 205 is restricted by the stopper 212. The stopper 212 is coupled to a ball-screw mechanism 215, which is configured to be capable of vertically moving the stopper 212 at a set speed.

A peripheral portion of the wafer W is polished in the following manner. While rotating the wafer W about its axis, a liquid (e.g., pure water) is supplied onto an upper surface of the wafer W. The air cylinder 209 exerts a constant pressing force on the pressing member 208, which in turn presses the polishing tape 205 against the edge portion of the wafer W. As shown in FIGS. 16A and 16B, during polishing of the wafer W, the stopper 212 is lowered at a constant speed by the ball-screw mechanism 215 while the positioning member 211 keeps in contact with the stopper 212. The polishing tape 205 is pressed against the edge portion of the wafer W by the gradually descending pressing member 208 to polish the edge portion of the wafer W at a constant polishing rate, thereby forming a stepped recess in the peripheral portion of the wafer W.

However, the polishing load applied to the pressing member 208 during polishing of the wafer W changes depending on a hardness of a surface layer of the wafer W. For example, the first and second silicon layers 201, 203 are softer than the patterned layer 202; therefore, a force transmitted from the positioning member 211 to the stopper 212 during polishing of the first and second silicon layers 201, 203 is larger than a force transmitted from the positioning member 211 to the stopper 212 during polishing of the patterned layer 202. Accordingly, the polishing load during polishing of the patterned layer 202 is higher than the polishing load during polishing of the first and second silicon layers 201, 203. Consequently, the polishing load may exceed an appropriate range. Furthermore, if a surface layer of the wafer W is too hard, the stopper 212 may separate from the positioning member 211, resulting in an excessive polishing load.

SUMMARY OF THE INVENTION

According to embodiments, there are provided a polishing apparatus and a polishing method which can maintain a polishing load within an appropriate range.

Embodiments, which will be described below, relate to a polishing apparatus and a polishing method for polishing a substrate such as a wafer, and more particularly to a polishing apparatus and a polishing method for polishing an edge portion of a substrate with a polishing tool to form a stepped recess in the edge portion.

In one embodiment, there is provided a polishing apparatus comprising: a rotatable substrate holder for holding a substrate; a pressing member for pressing a polishing tool against the substrate; an actuator configured to control a pressing force of the pressing member; a positioning member which is movable together with the pressing member; a stopper arranged to restrict movement of the pressing member and the positioning member; a stopper moving mechanism configured to move the stopper in a predetermined direction; a polishing-load detector configured to obtain a load feedback value which varies according to a polishing load applied to the pressing member; and a stopper-speed determining device configured to determine a movement speed of the stopper which can allow the load feedback value to fall within a set range.

In one embodiment, the polishing-load detector includes a load measuring device located between the positioning member and the stopper, the load measuring device being arranged to measure a load transmitted from the positioning member to the stopper.

In one embodiment, the polishing-load detector further includes a polishing-load calculator for determining the load feedback value by subtracting a value of the load, measured by the load measuring device, from a value of a force generated by the actuator.

In one embodiment, the load feedback value is a value of the load measured by the load measuring device.

In one embodiment, the polishing-load detector includes a load measuring device located between the positioning member and the pressing member, the load feedback value being a value of the load measured by the load measuring device.

In one embodiment, the stopper-speed determining device stores therein in advance a target load value which is within the set range, and is configured to calculate the movement speed of the stopper which can minimize a deviation of the load feedback value from the target load value.

In one embodiment, there is provided a polishing method comprising: rotating a substrate; pressing a polishing tool against the substrate with a pressing member; moving a stopper in a predetermined direction while restricting movement of a positioning member with the stopper, the positioning member being coupled to the pressing member; obtaining a load feedback value which varies according to a polishing load applied to the pressing member; determining a movement speed of the stopper which can allow the load feedback value to fall within a set range; and moving the stopper in the predetermined direction at the determined movement speed.

In one embodiment, the substrate has a plurality of layers having different hardnesses, and wherein the movement speed of the stopper changes depending on the hardness of each layer.

According to the above-described embodiments, the movement speed of the stopper is determined based on a load feedback value that can vary depending on a hardness of a surface layer of a substrate. Since the stopper moves at the determined movement speed, the polishing load can be maintained within an appropriate range regardless of the hardness of the surface layer of the substrate.

DESCRIPTION OF EMBODIMENTS

Embodiments will now be described with reference to the drawings. A polishing apparatus and a polishing method according to the below-described embodiments polish a peripheral portion of a substrate by rubbing a polishing surface of a polishing tape against the peripheral portion of the substrate. A peripheral portion of a substrate is herein defined as a region including an outermost bevel portion, and a top edge portion and a bottom edge portion, both of which are located radially inwardly of the bevel portion.

Figure 1A:
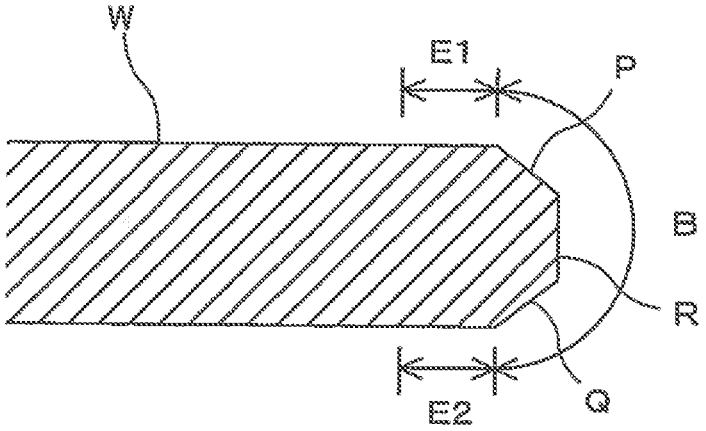
FIGS. 1A and 1B are enlarged cross-sectional views each showing a peripheral portion of a wafer which is an example of a substrate.
Figure 1B:
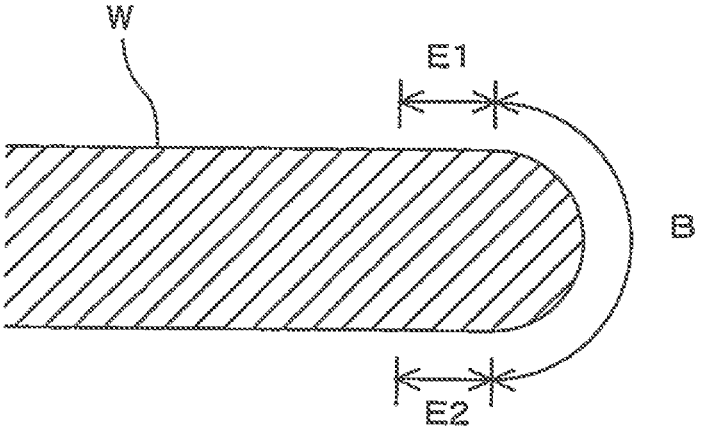

FIGS. 1A and 1B are enlarged cross-sectional views each showing a peripheral portion of a wafer which is an example of a substrate. More specifically, FIG. 1A is a cross sectional view of a wafer of a so-called straight type, and FIG. 1B is a cross sectional view of a wafer of a so-called round type. In a wafer W shown in FIG. 1A, a bevel portion is an outermost circumferential surface (indicated by symbol B) including an upper slope (or an upper bevel portion) P, a lower slope (or a lower bevel portion) Q, and a side portion (or an apex) R of the wafer W. In a wafer W shown in FIG. 1B, a bevel portion is a portion B constituting an outermost circumferential surface of the wafer W and having a curved cross section. The top edge portion is a flat portion E1 located radially inwardly of the bevel portion B. The bottom edge portion is a flat portion E2 located radially inwardly of the bevel portion B and located at an opposite side from the top edge portion. The top edge portion may include a region where devices are formed. In the following descriptions, the top edge portion will be simply referred to as an edge portion.

Figure 2:
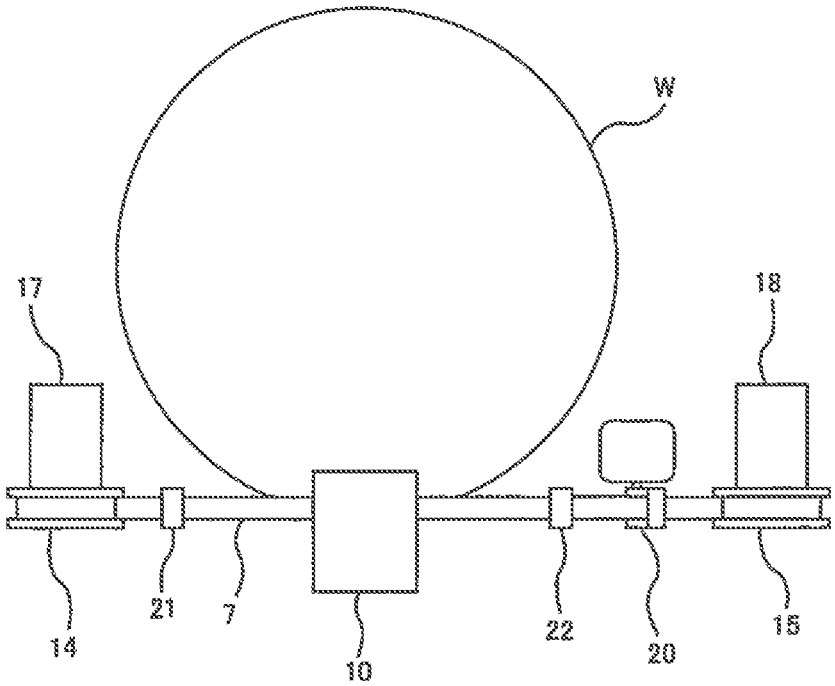
FIG. 2 is a plan view schematically showing an embodiment of a polishing apparatus.
Figure 3:
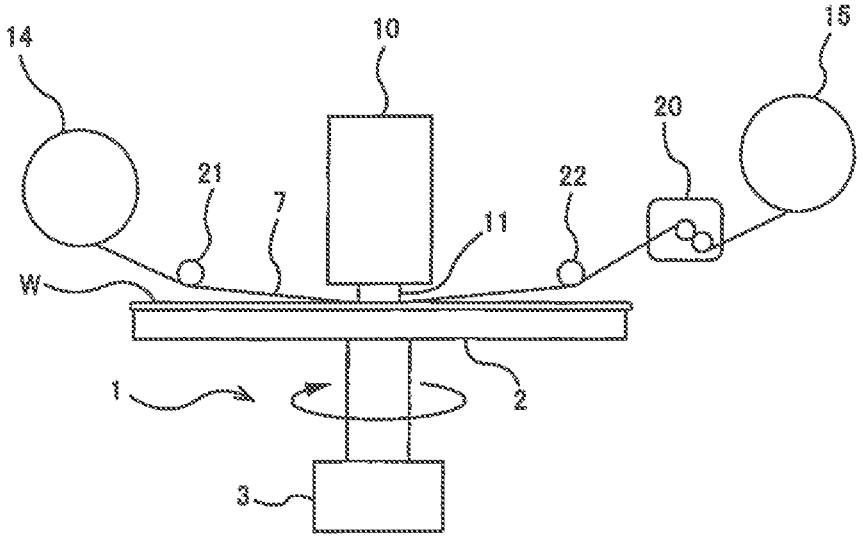
FIG. 3 is a side view of the polishing apparatus shown in FIG. 2.

FIG. 2 is a plan view schematically showing an embodiment of a polishing apparatus, and FIG. 3 is a side view of the polishing apparatus shown in FIG. 2. The polishing apparatus includes a wafer holder (or a substrate holder) 1 for holding and rotating a wafer W which is an example of a substrate. This wafer holder 1 has a wafer stage (or a substrate stage) 2 capable of holding the wafer W thereon, and a stage motor 3 for rotating the wafer stage 2 about its axis. The wafer W, to be polished, is held on an upper surface of the wafer stage 2 by vacuum suction or other holding technique, and is rotated together with the wafer stage 2 by the stage motor 3.

The polishing apparatus includes a polishing head 10 having a pressing member 11 for pressing a polishing tape 7 against an edge portion of the wafer W. The pressing member 11 is located above the wafer stage 2. The polishing tape 7 is a polishing tool for polishing the wafer W. One end of the polishing tape 7 is secured to a feeding reel 14, and other end of the polishing tape 7 is secured to a take-up reel 15. Most part of the polishing tape 7 is wound on both the feeding reel 14 and the take-up reel 15, and a part of the polishing tape 7 extends between the feeding reel 14 and the take-up reel 15. The feeding reel 14 and the take-up reel 15 are coupled to reel motors 17, 18, respectively, which apply torques in opposite directions to the feeding reel 14 and the take-up reel 15, respectively, to thereby apply a tension to the polishing tape 7.

A tape-advancing device 20 is disposed between the feeding reel 14 and the take-up reel 15. The polishing tape 7 is advanced by the tape-advancing device 20 at a constant speed from the feeding reel 14 to the take-up reel 15. The polishing tape 7, extending between the feeding reel 14 and the take-up reel 15, is supported by two guide rollers 21, 22. These two guide rollers 21, 22 are arranged between the feeding reel 14 and the take-up reel 15. A lower surface of the polishing tape 7 extending between the guide rollers 21, 22 serves as a polishing surface for polishing the wafer W. Instead of the polishing tape 7, a fixed abrasive may be used as the polishing tool.

The polishing head 10 has the pressing member 11 for pressing the polishing tape 7 against the edge portion of the wafer W. This pressing member 11 is located between the two guide rollers 21, 22. These guide rollers 21, 22 are arranged such that the polishing tape 7, existing between the guide rollers 21, 22, extends in a tangential direction of the wafer W at a contact point between the edge portion of the wafer W and the polishing tape 7.

Polishing of the wafer W is performed as follows. The wafer W, with a film (e.g., a device layer) formed thereon facing upward, is held on the wafer stage 2. The wafer W is then rotated together with the wafer stage 2 about the axis of the wafer stage 2. A polishing liquid (e.g., pure water) is supplied from a liquid supply nozzle (not shown) onto a center of the rotating wafer W. In this state, the pressing member 11 of the polishing head 10 presses the polishing tape 7 against the edge portion of the wafer W. The wafer is polished by the sliding contact of the rotating wafer W and the polishing tape 7. As shown in FIG. 2, the polishing tape 7, when polishing the wafer W, extends in the tangential direction of the wafer W at the contact point of the wafer W and the polishing tape 7.

Figure 4:
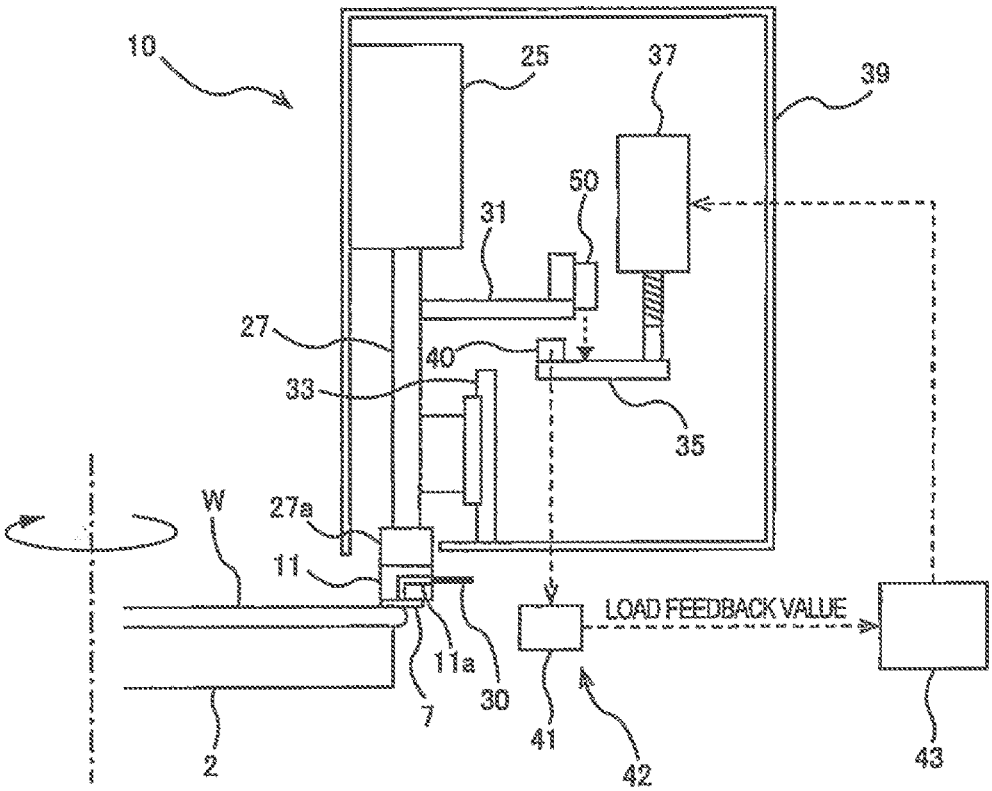
FIG. 4 is a diagram showing a polishing head.

FIG. 4 is a diagram showing the polishing head 10. As shown in FIG. 4, the polishing head 10 includes the pressing member 11 for pressing the polishing tape 7 against the wafer W, an air cylinder 25 for controlling a pressing force of the pressing member 11, and a load transmission member 27 coupling the pressing member 11 and the air cylinder 25 to each other. The air cylinder 25 is an actuator that biases or forces the pressing member 11 in a predetermined direction toward the wafer W on the wafer holder 1. In this embodiment, the air cylinder 25 is configured to bias or force the pressing member 11 downwardly toward the edge portion of the wafer W. In this embodiment, the pressing member 11 is biased by the air cylinder 25 in a direction parallel to the axis of the wafer holder 1, i.e. in the vertical direction. A lower portion of the load transmission member 27 is configured as a pressing member holder 27*a* for detachably holding the pressing member 11. The force generated by the air cylinder 25 is transmitted to the pressing member 11 via the load transmission member 27.

The pressing member 11 has a through-hole 11*a* formed therein. One end of the through-hole 11*a* opens in the lower surface of the pressing member 11, while the other end of the through-hole 11*a* is coupled to a vacuum line 30. The vacuum line 30 is equipped with a not-shown valve, so that a vacuum can be created in the through-hole 11*a* of the pressing member 11 by opening the valve. When the vacuum is created in the through-hole 11*a* with the pressing member 11 in contact with the upper surface of the polishing tape 7, the upper surface of the polishing tape 7 is held on the lower surface of the pressing member 11.

The pressing member 11 is secured to the load transmission member 27. A positioning member 31 is also secured to the load transmission member 27. The pressing member 11, the load transmission member 27, and the positioning member 31 constitute an integrated structure and are moved together by the air cylinder 25. The load transmission member 27 is movably coupled to a linear motion guide 33 that extends along the axis of the wafer holder 1. Accordingly, a direction of movement of the pressing member 11, the load transmission member 27, and the positioning member 31 as a whole is restricted to a direction parallel to the axis of the wafer holder 1. In this embodiment, the axis of the wafer holder 1 extends in the vertical direction.

The polishing head 10 further includes a stopper 35 disposed below the positioning member 31, a stopper moving mechanism 37 coupled to the stopper 35, and a load cell 40, as a load measuring device, disposed on the stopper 35. The stopper moving mechanism 37 is a device for moving the stopper 35 at a controlled speed. For example, the stopper moving mechanism 37 includes a ball-screw mechanism coupled to the stopper 35, and a servomotor for driving the ball-screw mechanism. In this embodiment, the stopper moving mechanism 37 is configured to move the stopper 35 downward during polishing of the wafer W. The direction in which the stopper moving mechanism 37 moves the stopper 35 is the same as the direction in which the air cylinder 25 biases or forces the pressing member 11 toward the edge portion of the wafer W. The air cylinder 25, the linear motion guide 33, and the stopper moving mechanism 37 are secured to a frame 39.

The stopper 35 is located just under the positioning member 31. Therefore, the downward movement of the pressing member 11, the load transmission member 27, and the positioning member 31, which constitute an integrated structure, is restricted by the stopper 35. The load cell 40 is disposed between the positioning member 31 and the stopper 35. In this embodiment, the load cell 40 is fixed to the upper surface of the stopper 35, and can contact the lower surface of the positioning member 31. When the pressing member 11, the load transmission member 27, and the positioning member 31 are lowered by the air cylinder 25, the positioning member 31 comes into contact with the load cell 40. The load cell 40 can then measure a load transmitted from the positioning member 31 to the stopper 35.

Figure 5:
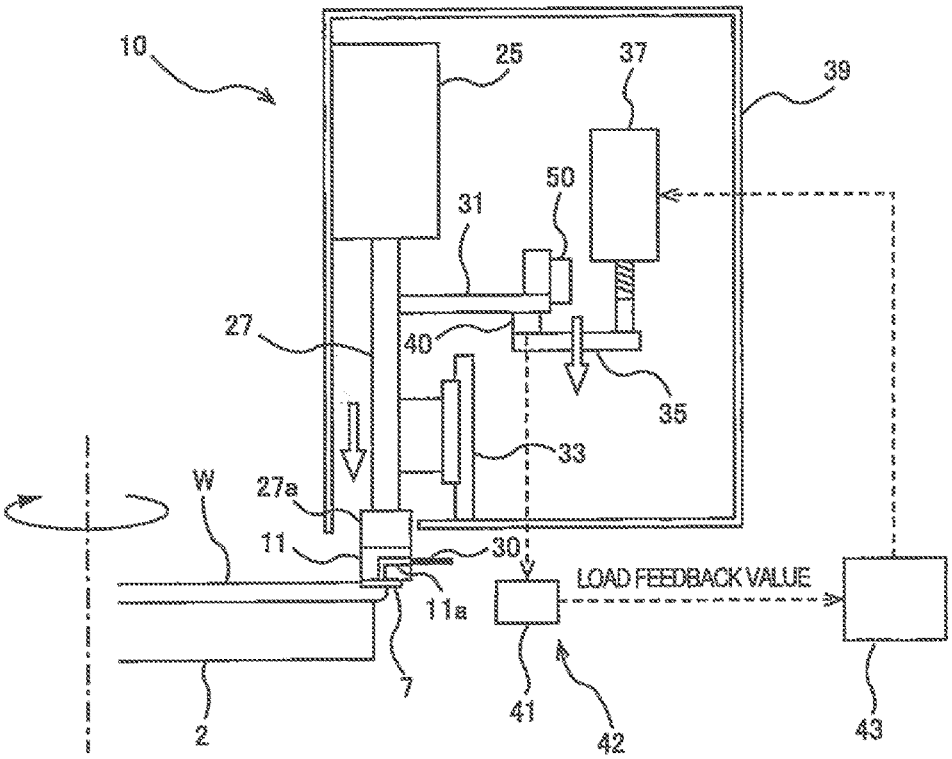
FIG. 5 is a diagram showing the polishing head which is polishing a wafer.

The edge portion of the wafer W is polished in the following manner. As shown in FIG. 5, while the wafer W is rotated about its axis, the polishing liquid (not shown), such as pure water, is supplied onto the upper surface of the wafer W. The air cylinder 25 forces the pressing member 11 toward the wafer W, so that the pressing member 11 presses the polishing tape 7 against the edge portion of the wafer W to polish the edge portion. During polishing of the wafer W, the air cylinder 25 generates a constant force. Further, during polishing of the wafer W, the stopper 35, while restricting the downward movement of the positioning member 31, is lowered by the stopper moving mechanism 37. As the stopper 35 is lowered, the pressing member 11 and the positioning member 31 are also lowered together. In other words, a relative position of the stopper 35, the pressing member 11, and the positioning member 31 is constant (or unchanged) during polishing of the wafer W. The polishing tape 7 is pressed against the edge portion of the wafer W by the descending pressing member 11, thereby forming a stepped recess in the peripheral portion of the wafer W.

During polishing of the wafer W, a part of the force generated by the air cylinder 25 is transmitted from the positioning member 31 to the stopper 35 via the load cell 40. Accordingly, a polishing load applied to the pressing member 11 is lower than the force generated by the air cylinder 25. The load cell 40 is configured to measure the force (load) transmitted from the positioning member 31 to the stopper 35, and to send a measurement value of the load to a polishing-load calculator 41. The polishing-load calculator 41 calculates a value of the polishing load based on the value of the load measured by the load cell 40 and the value of the force generated by the air cylinder 25. More specifically, the polishing-load calculator 41 determines a value of the polishing load by subtracting the value of the load measured by the load cell 40 from the value of the force generated by the air cylinder 25.

Figure 6:
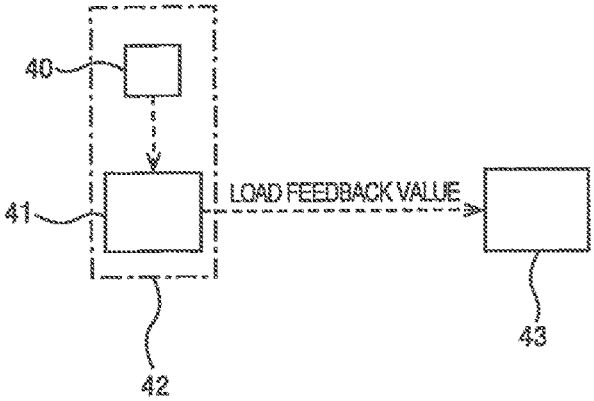
FIG. 6 is a diagram showing an embodiment of a polishing-load detector for obtaining a load feedback value.

In this embodiment, a load feedback value, which varies according to the polishing load, is a value of the polishing load calculated by the polishing-load calculator 41. As shown in FIG. 6, a polishing-load detector 42 for obtaining the load feedback value is composed of the load cell 40 and the polishing-load calculator 41. In one embodiment, a load feedback value, which varies according to the polishing load, may be a value of the load measured by the load cell 40. In that case, the polishing-load detector 42 for obtaining the load feedback value may be composed of the load cell 40, i.e., may not be provided with the polishing-load calculator 41.

Figure 15:
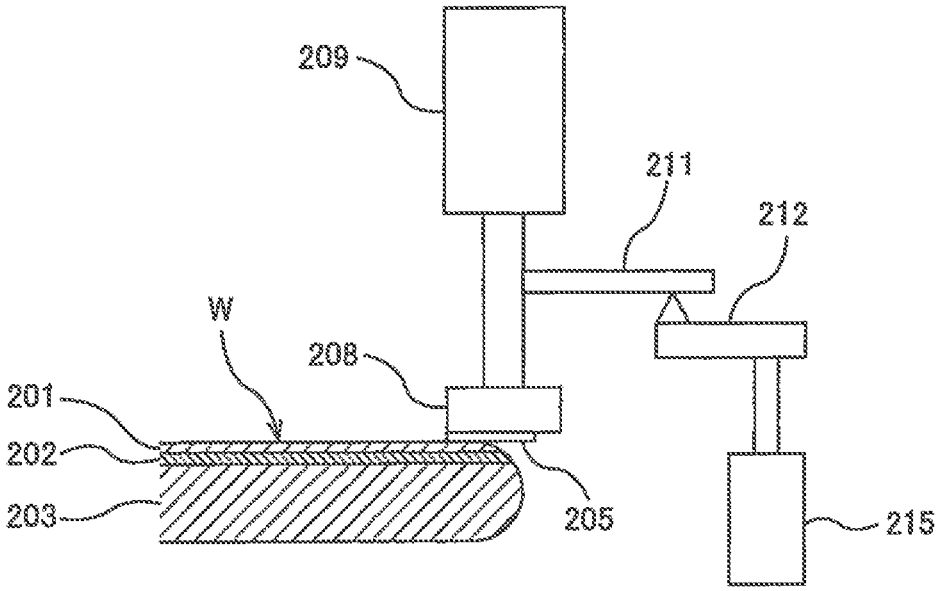
FIG. 15 is a diagram showing a conventional polishing apparatus.
Figure 16A:
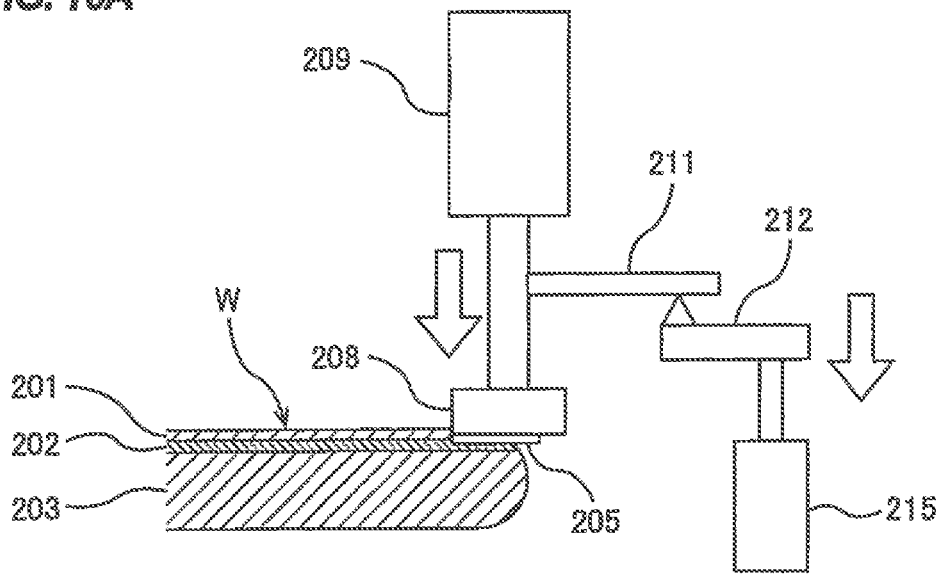
FIGS. 16A and 16B are diagrams showing the conventional polishing apparatus which is polishing a wafer.
Figure 16B:
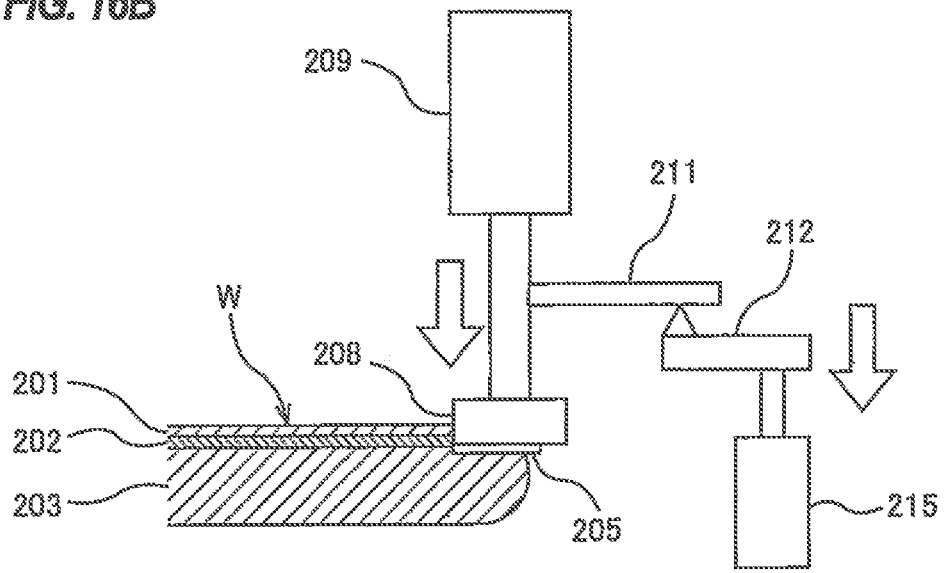
PRIOR ART FIG. 16B

When the descending speed of the stopper 35 is constant, the polishing load may vary depending on a hardness of a surface layer of the wafer W. In particular, the polishing load is large in a case of a hard surface layer, while the polishing load is small in a case of a soft surface layer. As shown in FIG. 15, the wafer W to be polished in this embodiment has a plurality of layers having different hardnesses. Therefore, the polishing load may change with the progress of polishing of the wafer W. A large change in the polishing load makes the polishing efficiency unstable. For example, if the polishing load is too large, an excessive pressure will be applied to the polishing tape 7. On the other hand, if the polishing load is too small, the polishing efficiency will be lowered.

In view of the above, the polishing apparatus according to this embodiment includes a stopper-speed determining device 43 for determining a movement speed of the stopper 35 which can make the polishing load fall within an appropriate range. The stopper-speed determining device 43 is configured to determine a movement speed of the stopper 35 based on the load feedback value obtained by the polishing-load detector 42 (the load cell 40 and the polishing-load calculator 41 in this embodiment). The polishing-load calculator 41 is coupled to the stopper-speed determining device 43 so that the load feedback value obtained by the polishing-load calculator 41 is sent to the stopper-speed determining device 43. The stopper-speed determining device 43 is coupled to the stopper moving mechanism 37 so that a determined value of the movement speed of the stopper 35 is sent to the stopper moving mechanism 37. The stopper moving mechanism 37 moves (lowers) the stopper 35 at the determined movement speed.

A set range, corresponding to an appropriate range of the polishing load, is pre-stored in the stopper-speed determining device 43. This set range has been determined so that an appropriate polishing load will be applied to the pressing member 11. A target load value is also pre-stored in the stopper-speed determining device 43. This target load value is a value within the set range. The stopper-speed determining device 43 is configured to determine a movement speed (descending speed) of the stopper 35 which can minimize a deviation of a load feedback value, obtained by the polishing-load detector 42 (the load cell 40 and the polishing-load calculator 41 in this embodiment), from the target load value. For example, the stopper-speed determining device 43 performs feedback control, such as PID control, to determine a movement speed of the stopper 35 that can minimize the deviation. Such feedback control can maintain the polishing load, applied to the pressing member 11, within the appropriate range during polishing of the wafer W.

According to this embodiment, the speed of movement of the stopper 35 changes according to a hardness of a surface layer (to-be-polished layer) of the wafer W during polishing of the wafer W. The polishing load applied to the pressing member 11 can therefore be maintained within an appropriate range regardless of the hardness of the surface layer of the wafer W.

Figure 7:
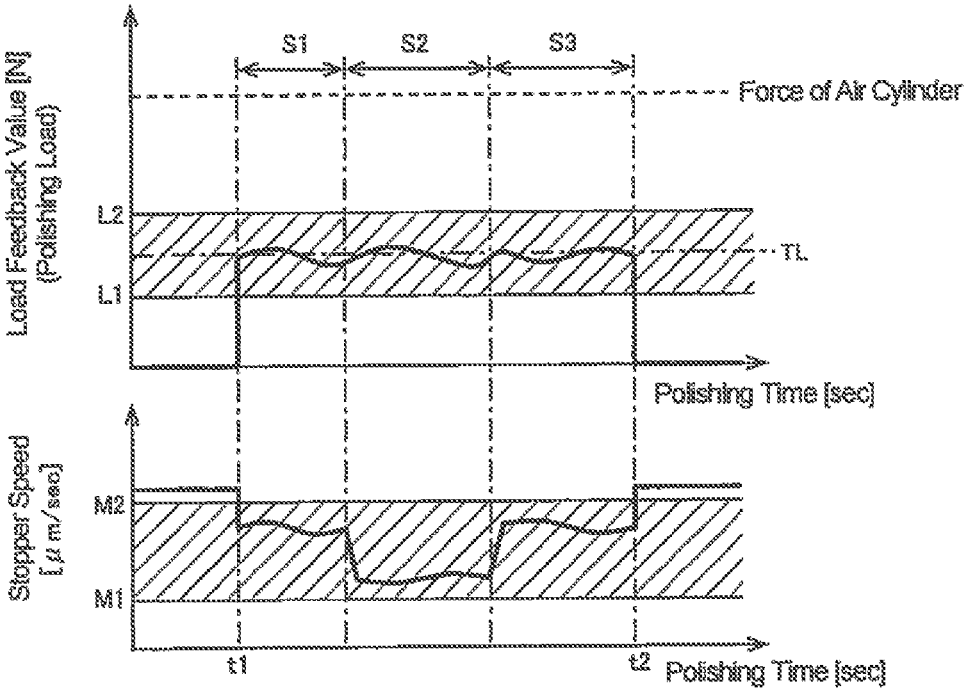
FIG. 7 is a graph showing load feedback value and speed of movement (descent) of a stopper as observed when a peripheral portion of a wafer is polished with the polishing apparatus of the embodiment.

FIG. 7 is a graph showing the load feedback value and the movement (descent) speed of the stopper 35, observed when a peripheral portion of a wafer was polished with the polishing apparatus of this embodiment. In this experiment, the wafer shown in FIG. 15 was polished. Polishing of the wafer was started at time t1 and terminated at time t2. The load feedback value in this experiment was the value of the polishing load calculated by the polishing-load calculator 41. A symbol S1 represents a section during which the first silicon layer 201 (see FIG. 15) of the wafer was polished, a symbol S2 represents a section during which the patterned layer 202 (see FIG. 15) of the wafer was polished, and a symbol S3 represents a section during which the second silicon layer 203 (see FIG. 15) of the wafer was polished. A symbol TL represents a target load value. As shown in FIG. 7, during polishing of the wafer, the movement speed of the stopper 35 varied depending on the hardness of the layer being polished, while the load feedback value fell within a set range of L1 to L2.

Figure 8:
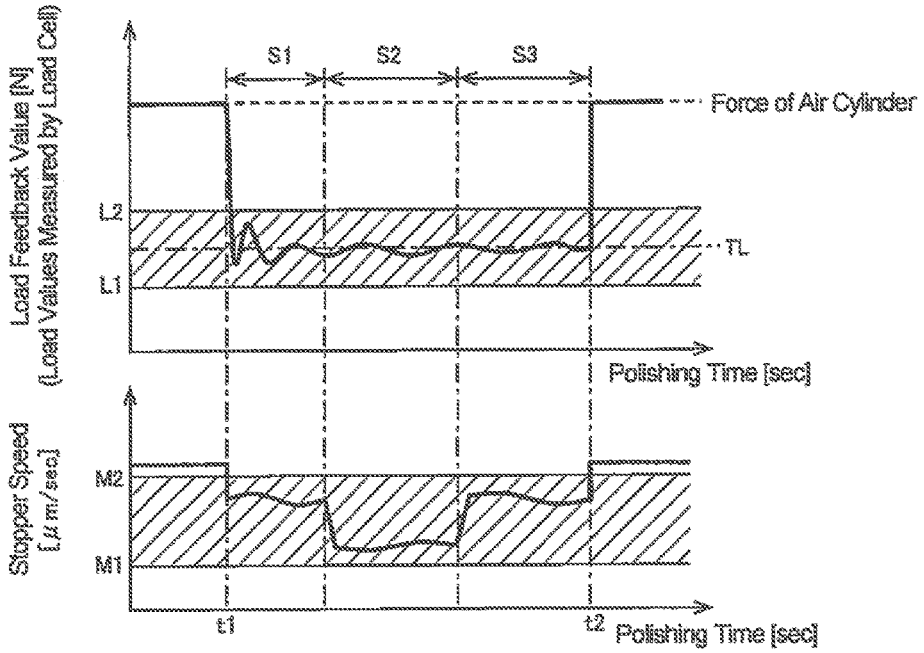
FIG. 8 is a graph showing load feedback value and speed of movement (descent) of the stopper as observed when a load value, measured by a load cell, is used as the load feedback value.

A value of the load measured by the load cell 40 may be used as the load feedback value that varies according to the polishing load. In that case, the polishing-load detector 42 is composed of the load cell 40. FIG. 8 is a graph showing the load feedback value and the movement (descent) speed of the stopper 35, observed when the value of the load measured by the load cell 40 was used as the load feedback value. Also in this embodiment, the load feedback value was found to fall within a set range of L1 to L2. The set range of L1 to L2 shown in FIG. 8 may differ from the set range of L1 to L2 shown in FIG. 7.

The load feedback value and/or the determined value of the movement speed of the stopper 35 may excessively increase or decrease due to various causes, such as detachment of the wafer W from the wafer holder 1, a failure of the load cell 40, etc. In view of this, when the load feedback value is out of the set range (from L1 to L2) and/or the determined value of the movement speed of the stopper 35 is out of a predetermined range (from M1 to M2), the stopper-speed determining device 43 may emit an alarm signal.

Figure 9:
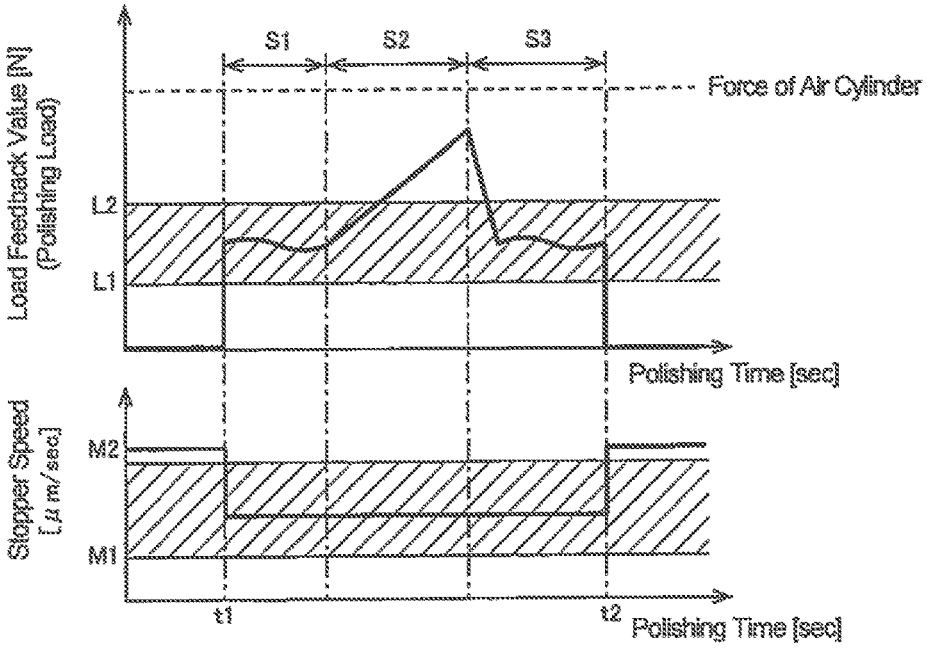
FIG. 9 is a graph showing load feedback value and speed of movement (descent) of the stopper as observed when the stopper is moved at a constant speed during polishing of a wafer.

FIG. 9 is a graph showing the load feedback value and the speed of the stopper 35, observed when the stopper 35 was moved at a constant speed during polishing of a wafer. Also in this experiment, the wafer shown in FIG. 15 was polished. The load feedback value in this experiment was the value of the polishing load calculated by the polishing-load calculator 41. As shown in FIG. 9, it was found in this experiment that the load feedback value increased in excess of the set range. As can be appreciated from a comparison between the graph of FIG. 7 and the graph of FIG. 9, the polishing apparatus and the polishing method of this embodiment can make the load feedback value, i.e. the polishing load, fall within an appropriate range by changing the movement speed of the stopper 35, i.e., the movement speed of the pressing member 11, during polishing of a wafer.

Figure 10:
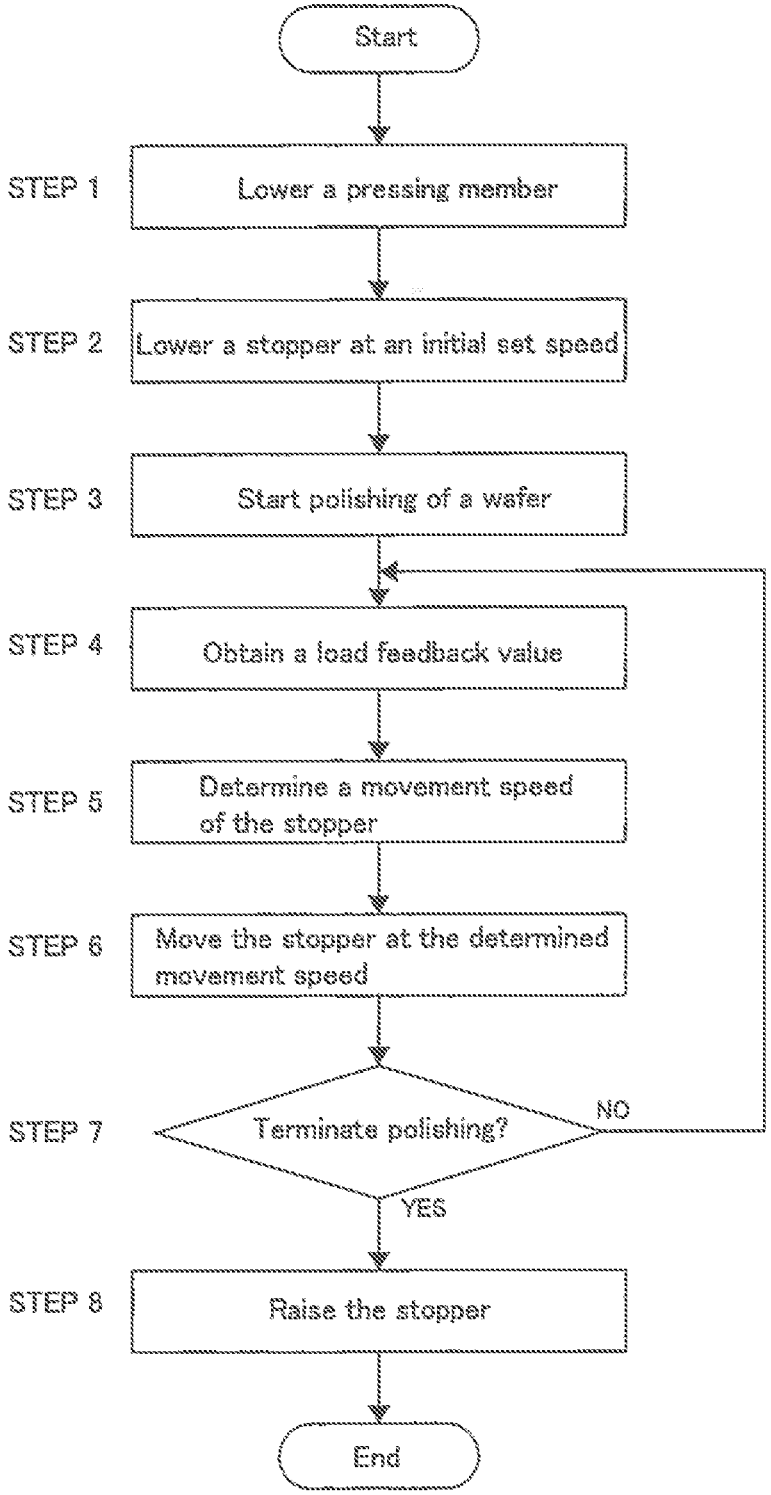
FIG. 10 is a flow chart illustrating a wafer polishing process.

A process for polishing the wafer W will now be described with reference to FIG. 10. First, with the polishing tape 7 being at a sufficient distance from the edge portion of the wafer W, the pressing member 11 is lowered by the air cylinder 25 until the positioning member 31 comes into contact with the load cell 40 on the stopper 35 (step 1). While the positioning member 31 is kept in contact with the load cell 40, the stopper moving mechanism 37 lowers the stopper 35 at an initial set speed (step 2). As the stopper 35 is lowered, the positioning member 31, the pressing member 11, and the polishing tape 7 are lowered together at the same speed. Polishing of the wafer W is started upon contact of the polishing tape 7 with the edge portion of the wafer W (step 3). The polishing tape 7 is pressed against the edge portion of the wafer W by the descending pressing member 11 to polish the wafer W. During polishing of the wafer W, the load cell 40 measures the load transmitted from the positioning member 31 to the stopper 35, and the polishing-load calculator 41 calculates a value of the polishing load based on the measurement value sent from the load cell 40 and on the force generated by the air cylinder 25 (step 4).

Figure 11:
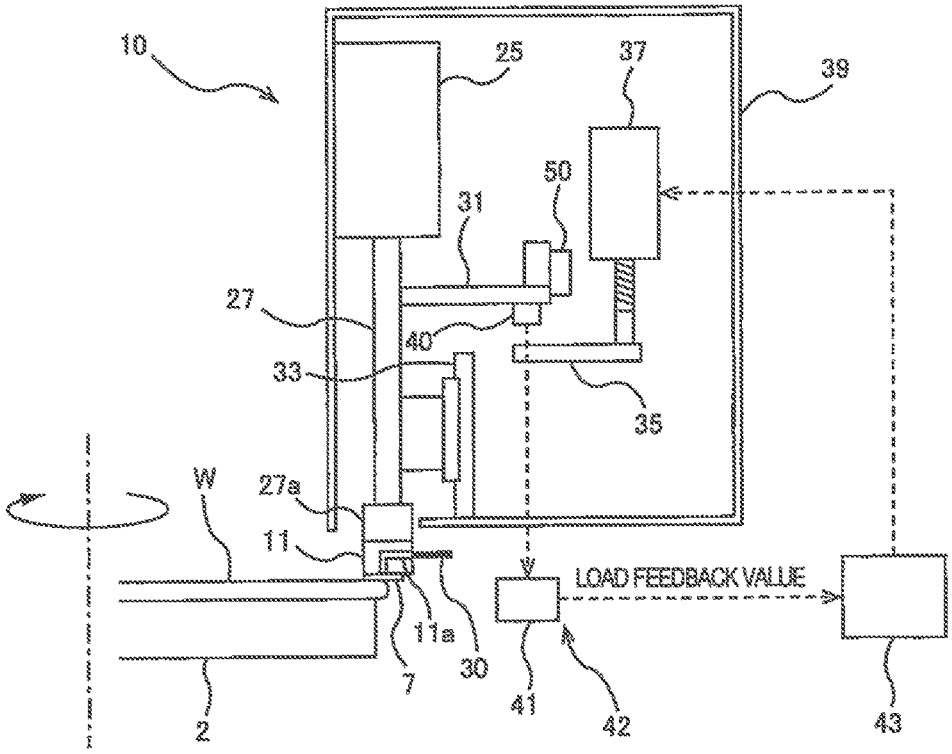
FIG. 11 is a diagram showing another embodiment of a polishing head.

The stopper-speed determining device 43 determines a movement speed (descending speed) of the stopper 35 which can minimize the deviation of the calculated value of the polishing load (i.e., the load feedback value) from a target load value (step 5). The determined value of the movement speed of the stopper 35 is sent to the stopper moving mechanism 37. The stopper moving mechanism 37 moves (lowers) the stopper 35 at the determined movement speed (step 6). Polishing of the wafer W is terminated when a preset target amount of polishing is reached (step 7). Upon the termination of polishing of the wafer W, the stopper 35 is elevated together with the positioning member 31 and the pressing member 11 (step 8). As shown in FIG. 4, the load cell 40 is disposed between the positioning member 31 and the stopper 35. While in this embodiment the load cell 40 is fixed to the upper surface of the stopper 35, the load cell 40 may be fixed to the lower surface of the positioning member 31, as shown in FIG. 11. Further, in one embodiment, the load cell 40 may be disposed between the positioning member 31 and the pressing member 11. For example, as shown in FIG. 12, the load cell 40 may be incorporated in the load transmission member 27.

Figure 12:
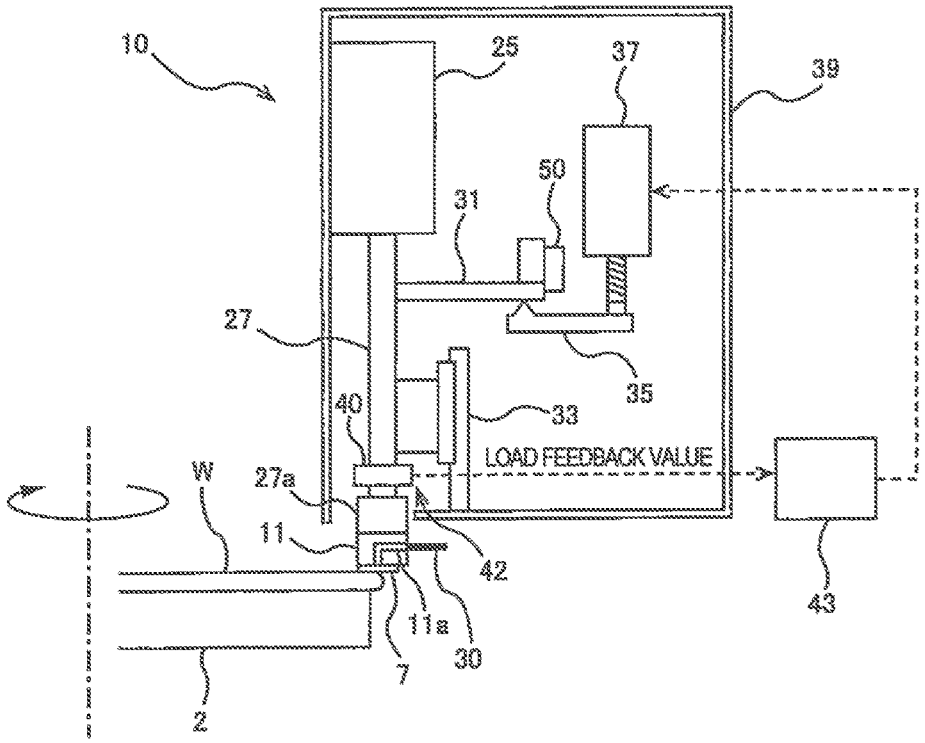
FIG. 12 is a diagram showing yet another embodiment of a polishing head.

Since the load cell 40 is disposed between the positioning member 31 and the pressing member 11 in the embodiment shown in FIG. 12, the load cell 40 can directly measure the polishing load. In this embodiment, the polishing-load detector 42 for obtaining a load feedback value, which varies according to the polishing load, is comprised of the load cell 40 which is a load measuring device. In this embodiment, the load feedback value is a value of the load measured by the load cell 40. It is noted that the load cell 40 cannot be disposed between the air cylinder 25 and the positioning member 31. This is because the load cell 40, disposed in such a position, cannot measure the polishing load applied to the pressing member 11 although it can measure the force itself generated by the air cylinder 25.

Figure 13A:
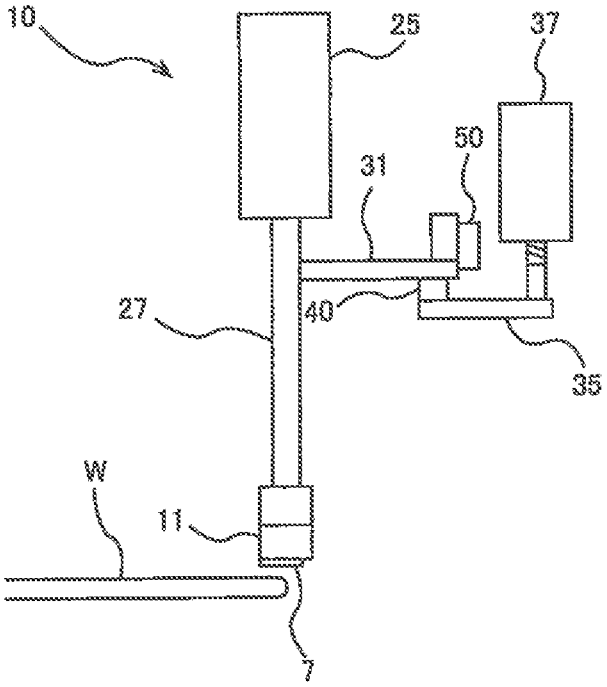
FIGS. 13A and 13B are diagrams illustrating a method for determining a polishing start point.
Figure 13B:
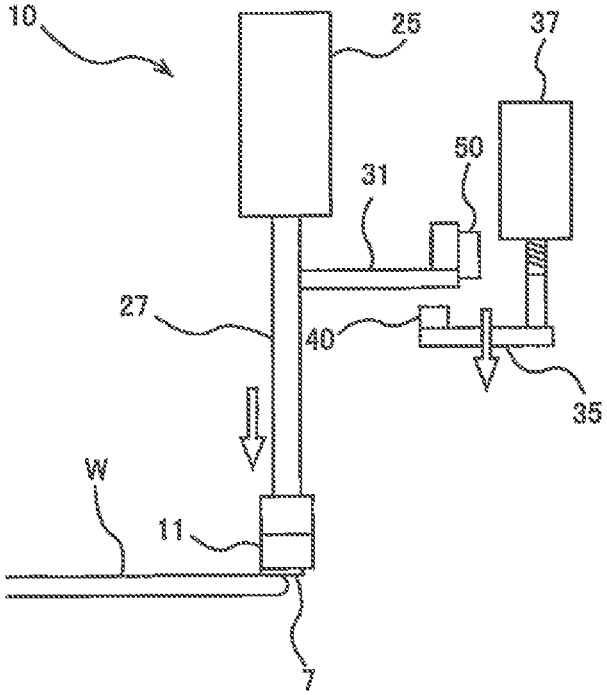

Polishing of the wafer W is terminated when the target amount of polishing is reached. In order to polish the wafer W accurately by the target amount of polishing, it is necessary to determine a polishing start point. A method for determining the polishing start point will now be described with reference to FIGS. 13A and 13B. First, the stopper 35 is raised by the stopper moving mechanism 37, or the positioning member 31 is lowered by the air cylinder 25 to bring the positioning member 31 and the load cell 40 into contact with each other (see FIG. 13A).

Next, while keeping contact between the positioning member 31 and the load cell 40, the positioning member 31 and the stopper 35 are lowered by the air cylinder 25 and the stopper moving mechanism 37 to move the polishing tape 7 and the pressing member 11 toward the edge portion of the wafer W. During this operation, the polishing tape 7, the pressing member 11, the positioning member 31, the load cell 40, and the stopper 35 are moved together. The load cell 40 is separated from the positioning member 31 at the moment when the polishing tape 7 comes into contact with the edge portion of the wafer W (see FIG. 13B). The position of the stopper 35 at that moment is the initial position of the stopper 35, and this initial position is determined to be the polishing start point. The point in time when the load cell 40 is separated from the positioning member 31 can be determined from a change in output signal of the load cell 40.

A distance sensor 50 is secured to the positioning member 31. This distance sensor 50 can measure a distance of the stopper 35 to the positioning member 31. The point in time when the load cell 40 is separated from the positioning member 31 may be determined from a change in output signal of the distance sensor 50. An alarm signal may be emitted when the stopper 35 is located largely away from the positioning member 31. In particular, an alarm signal may be emitted when the distance between the stopper 35 and the positioning member 31 has exceeded a threshold value.

An amount of polishing corresponds to a depth of a recess formed in the peripheral portion of the wafer W by the polishing tape 7. Accordingly, the target amount of polishing can be expressed by the distance of movement of the stopper 35 from the initial position (hereinafter referred to as the movement distance of the stopper 35).

Figure 14:
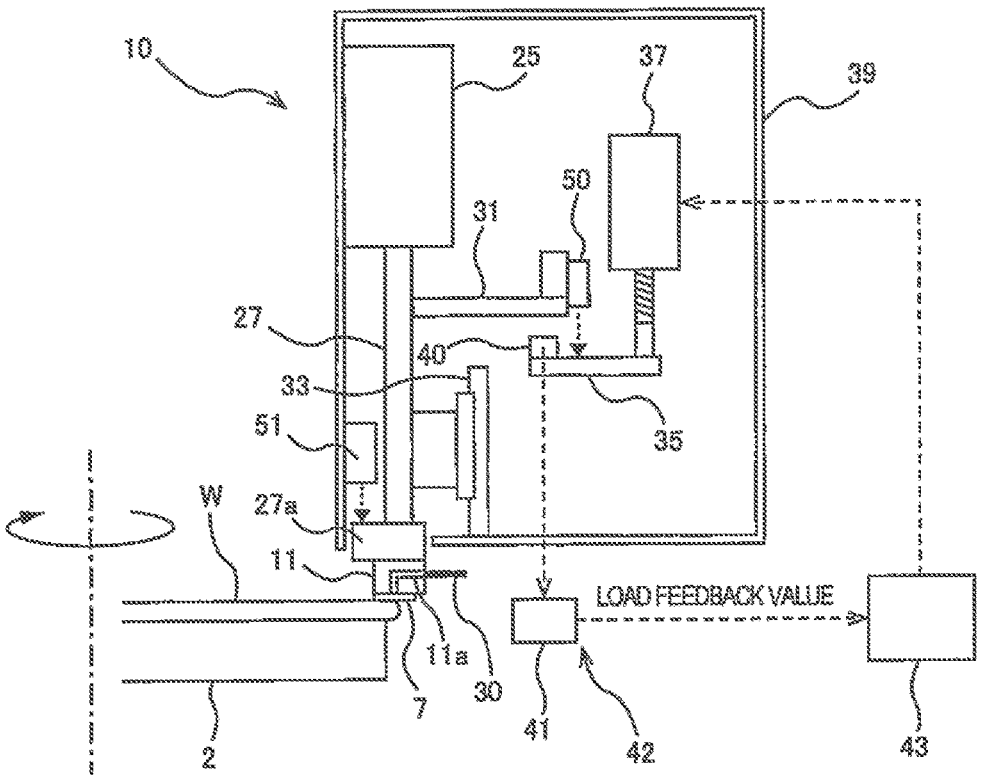
FIG. 14 is a diagram showing yet another embodiment of a polishing head.

Polishing of the wafer W is terminated when the movement distance of the stopper 35, corresponding to the target amount of polishing, is reached. The movement distance of the stopper 35 can be measured by a rotary encoder installed in the servomotor constituting the stopper moving mechanism 37. Alternatively, polishing of the wafer W may be terminated when the movement distance of the pressing member 11, measured by the distance sensor 51 shown in FIG. 14, reaches a distance corresponding to the target amount of polishing. The distance sensor 51 is secured to the frame 39, and is configured to be capable of measuring the movement distance of the pressing member 11. The relative position of the distance sensor 51, the air cylinder 25, and the stopper moving mechanism 37 is fixed.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a rotatable substrate holder for holding a substrate;

a pressing member for pressing a polishing tool against the substrate;

an actuator configured to control a pressing force of the pressing member;

a positioning member which is movable together with the pressing member;

a stopper arranged to restrict movement of the pressing member and the positioning member;

a stopper moving mechanism configured to move the stopper in a predetermined direction;

a polishing-load detector configured to obtain a load feedback value which varies according to a polishing load applied to the pressing member; and a stopper-speed determining device configured to determine a movement speed of the stopper which can allow the load feedback value to fall within a set range.

2. The polishing apparatus according to claim 1, wherein the polishing-load detector includes a load measuring device located between the positioning member and the stopper, the load measuring device being arranged to measure a load transmitted from the positioning member to the stopper.

3. The polishing apparatus according to claim 2, wherein the polishing-load detector further includes a polishing-load calculator for determining the load feedback value by subtracting a value of the load, measured by the load measuring device, from a value of a force generated by the actuator.

4. The polishing apparatus according to claim 2, wherein the load feedback value is a value of the load measured by the load measuring device.

5. The polishing apparatus according to claim 1, wherein the polishing-load detector includes a load measuring device located between the positioning member and the pressing member, the load feedback value being a value of the load measured by the load measuring device.

6. The polishing apparatus according to claim 1, wherein the stopper-speed determining device stores therein in advance a target load value which is within the set range, and is configured to calculate the movement speed of the stopper which can minimize a deviation of the load feedback value from the target load value.

7. A polishing method comprising:

rotating a substrate;

pressing a polishing tool against the substrate with a pressing member;

moving a stopper in a predetermined direction while restricting movement of a positioning member with the stopper, the positioning member being coupled to the pressing member;

obtaining a load feedback value which varies according to a polishing load applied to the pressing member;

determining a movement speed of the stopper which can allow the load feedback value to fall within a set range; and moving the stopper in the predetermined direction at the determined movement speed.

8. The polishing method according to claim 7, wherein the substrate has a plurality of layers having different hardnesses, and wherein the movement speed of the stopper changes depending on the hardness of each layer.

* * * * *